US005186106A

United States Patent [19]

Fischer et al.

[11] Patent Number: 5,186,106

[45] Date of Patent: Feb. 16, 1993

[54] ARRANGEMENT ON TRANSFER DRUM FOR IN-REGISTRY SHEET TRANSFER

[75] Inventors: Karl-Heinz Fischer; Arndt Jentzsch, both of Coswig, Fed. Rep. of Germany

[73] Assignee: KBA-Planeta AG, Radebeul, Fed. Rep. of Germany

[21] Appl. No.: 797,443

[22] Filed: Nov. 22, 1991

[30] Foreign Application Priority Data

Nov. 23, 1990 [DE] Fed. Rep. of Germany ..... 4037305

[51] Int. Cl.[5] ..... B41F 21/04; B65H 5/12; B65H 5/14

[52] U.S. Cl. ..... 101/242; 101/246; 101/410; 101/411; 271/277

[58] Field of Search ..... 101/183, 142, 154, 177, 101/217, 410, 409, 411, 242, 246; 271/247, 277, 82, 275

[56] References Cited

U.S. PATENT DOCUMENTS

| | | | |
|---|---|---|---|
| 3,556,006 | 1/1971 | Papa et al. | 101/246 |
| 3,682,472 | 8/1972 | Barthel | 101/409 |
| 3,899,970 | 8/1975 | Jurny et al. | 101/246 |
| 3,926,118 | 12/1975 | Preuss | 101/246 |
| 4,210,079 | 7/1980 | Raes | 101/217 |
| 4,370,928 | 2/1983 | Weisbach et al. | 101/242 |
| 4,378,734 | 4/1983 | Wirz | 101/410 |
| 4,535,691 | 8/1985 | Kida | 101/183 |
| 5,085,143 | 2/1992 | Becker | 101/183 |

*Primary Examiner*—Eugene H. Eickholt
*Attorney, Agent, or Firm*—Michael J. Striker

[57] ABSTRACT

An arrangement on transfer drums for in-registry sheet transfer in sheet rotary printing machines, has gripper units mounted on cylinders, toothed segments which during a sheet transfer are in engagement, each of the gripper units having a gripper shaft, a gripper and a turnable gripper traverse which receives the gripper shaft and said gripper and fixedly connected with one of the turnable toothed segments, and an elastic element associated with the toothed segment.

4 Claims, 3 Drawing Sheets

ARRANGEMENT ON TRANSFER DRUM FOR IN-REGISTRY SHEET TRANSFER

BACKGROUND OF THE INVENTION

The present invention relates to an arrangement on transfer drums for in-register sheet transfer in sheet rotary printing machines with gripper units which are mounted on cylinders and additionally arranged toothed segments which are in engagement during the sheet transfer.

Toothed segments on transfer drums are known. German document DE-AS 1,033,681 discloses a sheet transfer drum with such devices. In this device a known toothed rim with a springy toothed segment is arranged on the shaft of the transfer drum and engages with a drive wheel of the subsequent transfer drum and in addition a fixed toothed segment is provided. The fixed toothed segment cooperates only during the sheet transfer with an identical toothed segment mounted on the drive toothed rim of the preceding transfer drum. The springy toothed segment is axially offset relative to the fixed toothed segment. Due to this arrangement the registering device, during the sheet transfer in the event of a differences in registry, turns the drive wheel and thereby the transfer drum by the registry difference.

This device has the disadvantage that in the event of registry difference the drive wheel and thereby the transfer drum must be turned by the same difference. For turning these bodies which have great masses considerable tangential forces are needed, which lead to a premature wear of the toothed segments.

SUMMARY OF THE INVENTION

Accordingly, it is an object of the present invention to provide an arrangement on transfer drums which permits an index registry sheet transfer between the cylinders without performing a correction at the cylinder body.

In keeping with these objects and with others which will become apparent hereinafter, one feature of the present invention resides, briefly stated, in an arrangement on transfer drums for in-registry sheet transfer in a sheet rotary printing machine in which the gripper shaft and the gripper receiving turnable gripper traverse is fixedly connected with a turnable toothed segment, and elastic means are associated with the toothed segment.

When the arrangement is designed with the present invention an in-registry sheet transfer between the cylinders is possible without performing a correction on the cylinder body itself.

In accordance with another feature of the present invention, the elastic means are formed preferably as pressure springs and arranged at both sides of the gripper system.

The gripper traverses and the toothed segments can be arranged, in accordance with another feature of the present invention, centrally and rotatably with respect to the transfer drums.

The inventive arrangement is simple to make. It guarantees the registry-correct sheet transfer and so that high wear-causing tangential forces do not occur. This is achieved in that the gripper units are arranged inside the rigid transfer drum in a springy fashion, and with the obtained registry accuracy only the gripper units and not the whole transfer drum are displaced on the shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
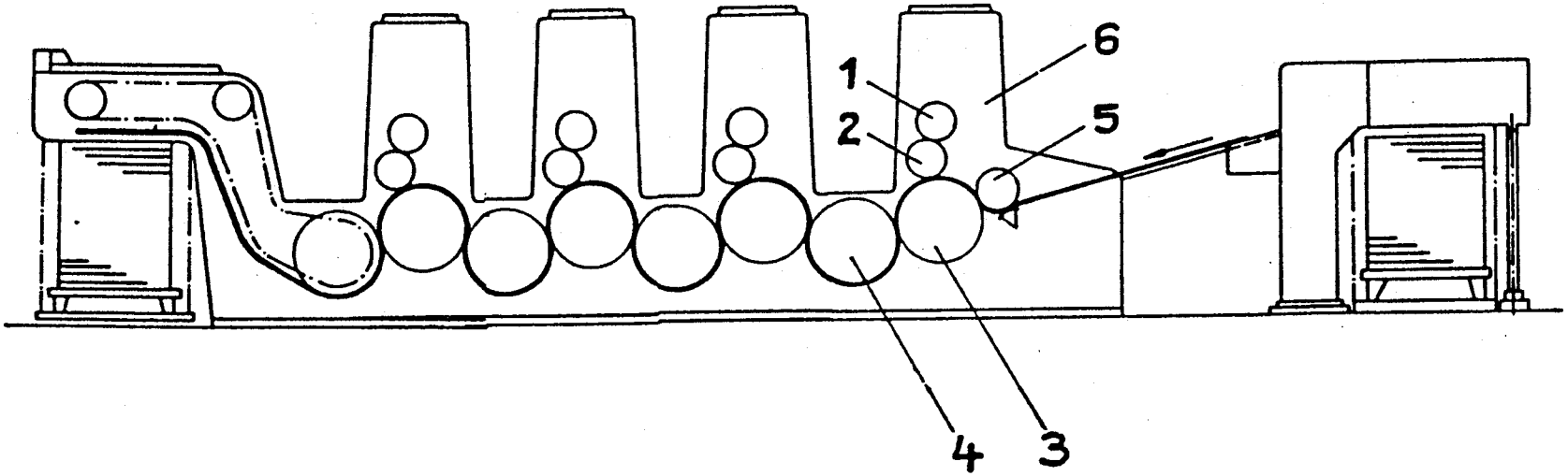
FIG. 1 is a side view schematically showing a four color printing machine.

A four color offset printing machine schematically shown in FIG. 1 includes four printing mechanisms with plate cylinders 1, rubber cylinders 2 and printing cylinders 3 which are connected with another by transfer drums 4. The paper is supplied in a known manner over the placing drum 5 to the first printing mechanism, and by means of transfer drums 4 and gripping units mounted on them to further printing mechanisms.

The gripping units of the transfer drums 4 include grippers 26, gripper shafts 9, and both parts of gripper traverses 10 which are connected with one another. To the contrary the gripping units of the printing cylinders 3 include only the gripper shafts 9 and the grippers 11.

Figure 2:
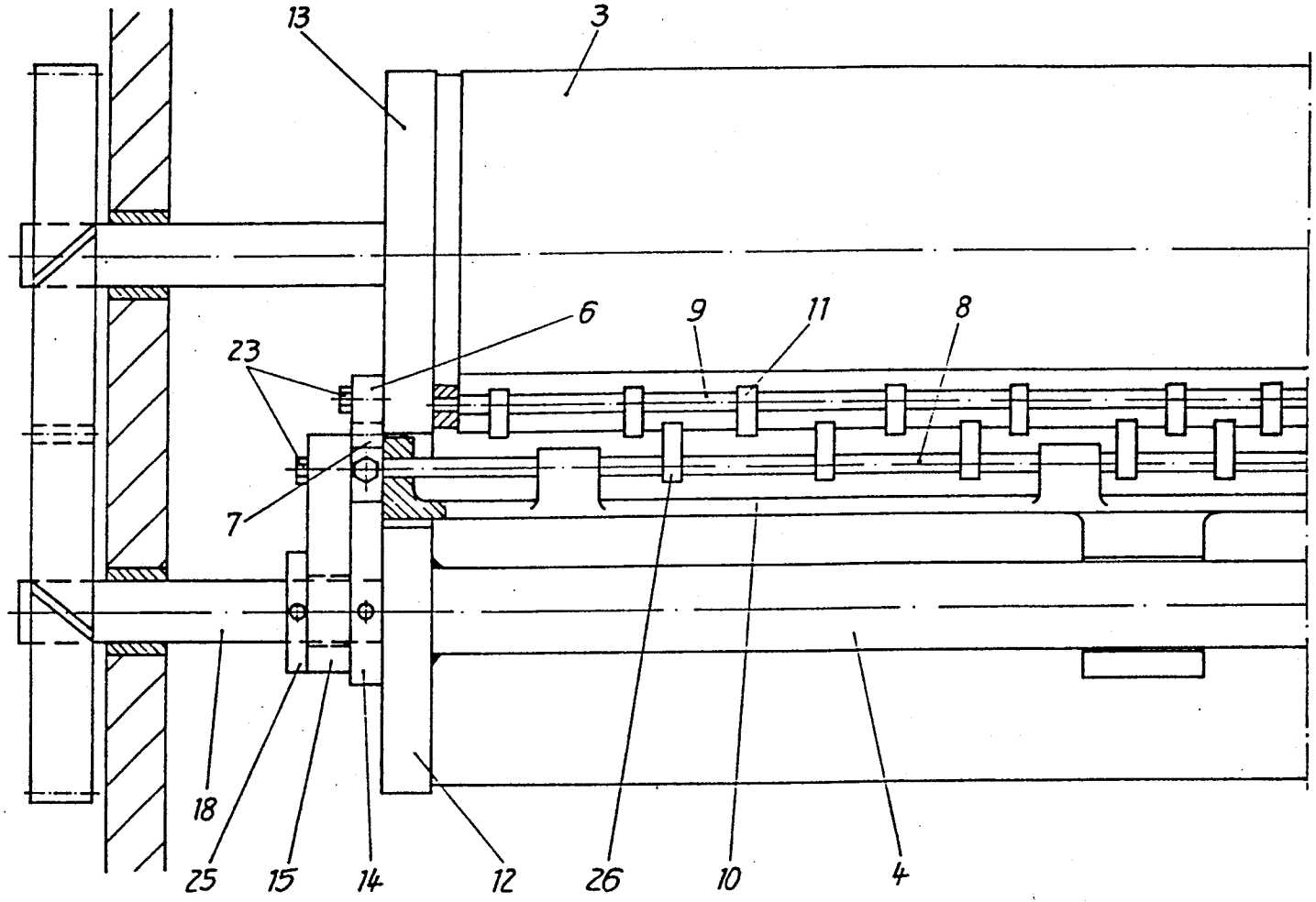
FIG. 2 is a front view of a cylinder with an inventive arrangement in the printing machine.

FIG. 2 shows the construction of the inventive arrangement. The printing cylinder 3 carries on each of its side discs 13 a toothed segment 6. The toothed segments 6 are arranged by means of several screws 23 on the periphery of the printing cylinder 3 so that the center of the central gaps of the toothed segment 6 is identical to the center of the gripper strike of the gripper cylinder 3. A lever 14 is located on the transfer drum pin 18 at the side of the housing near each side disc 12 fixedly arranged on the transfer drum 4. The lever 14 includes a a hub fitted on the transfer drum pin 18 and two forks 20 and 21 fixedly arranged on it. An opening 24 is provided at both upper ends of the forks 20 and 21 and have diameter greater than the diameter of the fork leg. The opening 24 extends transversely to the axis of the transfer drum 4.

The opening 24 in the outwardly extending part of the forks 20 and 21 is provided with an inner thread and has in its another part a rear diameter which is greater than the inner thread. A screw pin 16 with a pressure spring 16 fitted on the shaft is mounted in the openings 24. The distance of both inwardly located screw heads from one another is adjustable by means of a counternut 22. The lever 14 is arranged on a transfer drum pin 8 for joint rotation therewith. The fork ends lie in alignment with the gripper units mounted on the transfer drum 4.

A lever 15 is rotatably mounted on the transfer drum pin 18 at the side of the housing. The lever 15 includes a hub and a lever arm rigidly mounted on the hub. At the upper end of the lever 15, a further toothed segment 7 is mounted so that the center of a tooth of the toothed segment 7 is identical with the center of the gripper abutment of the transfer drum 4. The shape of the teeth and the type of the mounting is designed so that the toothed segment 7 can be bringable in engagement with the toothed segment 6. The toothed segment 7 arranged on the lever end 15 is fixedly connected in addition to the lever, also with the gripper traverse 10 by means of several screws 23.

The gripper traverse 10 and the toothed segments 7 are connected with one another and centrally rotatable relative to the transfer drum 4. The levers 14 are secured by adjusting ring against the axial displacement.

Figure 3:
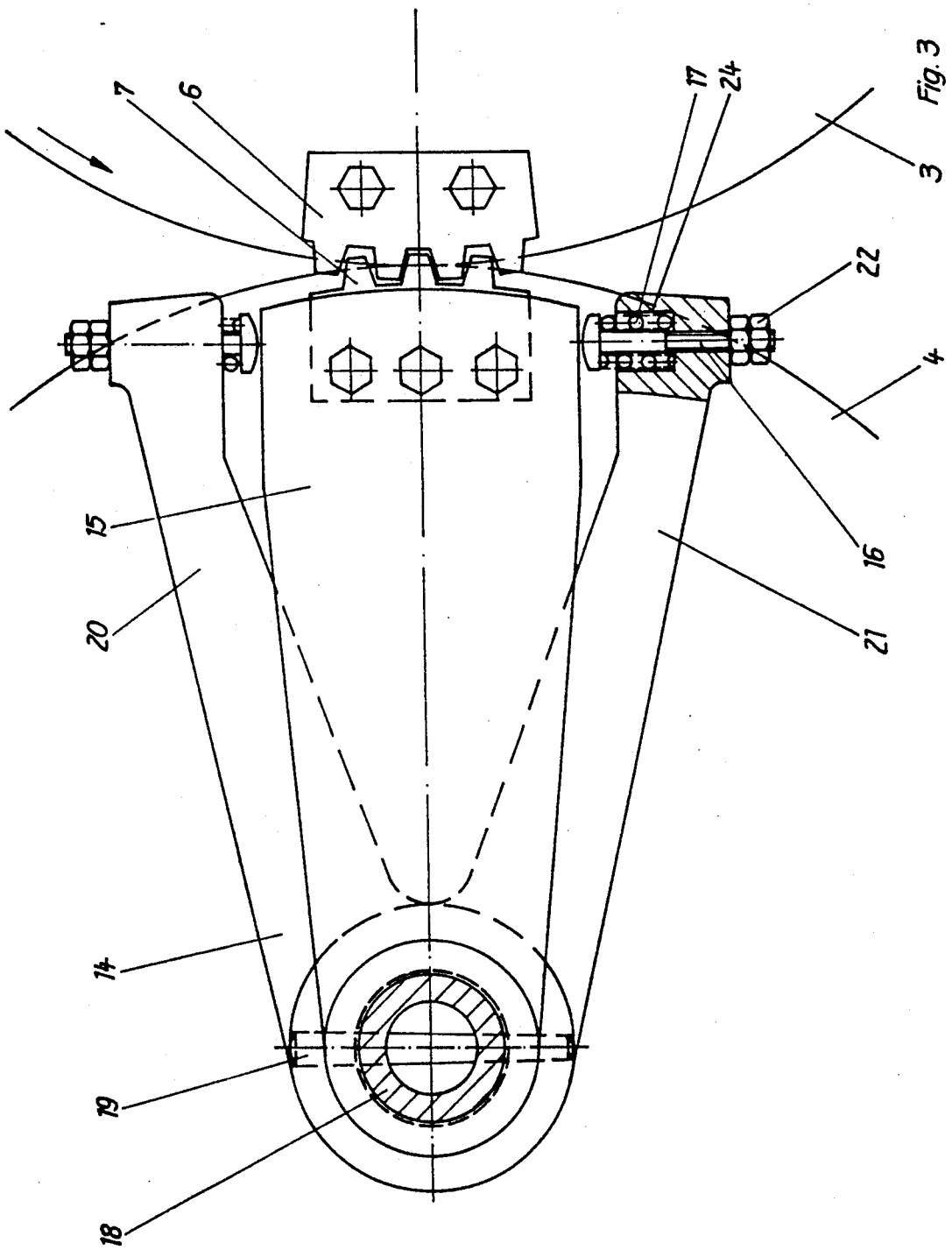
FIG. 3 is a side view of the inventive arrangement.

FIG. 3 shows the inventive device in a side view during the operation. The elastic arrangement of the toothed segment 7 is clearly shown in this drawing. The distance of the screw heads of the screw pins 16 must be adjusted so that the toothed segment 7 mounted on the lever 15 finds its place with a play of 0.05–0.1 mm at both sides. The inventive arrangement is respectively arranged at both sides on the side discs 12 and 13 on the printing cylinder 3 and on the transfer drum 4.

During the operation the following movement is performed:

The sheets are supplied from the first printing mechanism to the first transfer drum 4. There they are engaged by the grippers mounted on the gripper shaft 9 and transported to the subsequent printing cylinder 3.

If the registry between the transfer drum 4 and the printing cylinder 3 before the transfer of the sheet is not provided, it can be corrected with the inventive arrangement. This is performed so that the toothed segment 6 arranged on the printing cylinder 3 is brought into engagement during the sheet transfer with the toothed segment 7 on the transfer drum 4. Then the spring-biased toothed segment 7 which is connected with the gripper unit is displaced by the toothed segment 6 mounted on the printing cylinder 3 in a radial direction by the registry difference amount and the registry is again obtained. The same process takes place during the transfer of the sheet from the transfer drum 4 to the printing cylinder 3.

It will be understood that each of the elements described above, or two or more together, may also find a useful application in other types of constructions differing from the types described above.

While the invention has been illustrated and described as embodied in an arrangement on the transfer drums for in-registry sheet transfer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement on transfer drums for inregistry sheet transfer in sheet rotary printing machines having a plurality of cylinders and a plurality of transfer drums, the arrangement comprising first toothed segments mounted on the cylinders; a plurality of gripper units mounted on the cylinders and each having a gripper shaft, a gripper and a turnable gripper traverse which receives said gripper shaft and said gripper; turnable toothed segments connected with transfer drums and bringable in engagement with said first mentioned toothed segments mounted on the cylinders; and elastic means associated with said toothed segments for elastically mounting said toothed segments.

2. An arrangement as defined in claim 1, wherein said gripper traverses and said toothed segments are arranged centrally turnable relative to the transfer drums.

3. An arrangement as defined in claim 1, wherein said elastic means is arranged at both sides of said gripper traverse.

4. An arrangement as defined in claim 1, wherein said elastic means is formed by pressure springs.

* * * * *